US006773083B2

(12) United States Patent
Fields et al.

(10) Patent No.: US 6,773,083 B2
(45) Date of Patent: Aug. 10, 2004

(54) METHOD AND APPARATUS FOR NON-VOLATILE MEMORY USAGE IN AN INK JET PRINTER

(75) Inventors: Thomas Austin Fields, Winchester, KY (US); William Shannon Spencer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 316 days.

(21) Appl. No.: 09/942,358

(22) Filed: Aug. 29, 2001

(65) Prior Publication Data

US 2003/0043408 A1 Mar. 6, 2003

(51) Int. Cl.[7] ..... B41J 29/38
(52) U.S. Cl. ..... 347/5; 358/1.16
(58) Field of Search ..... 347/5, 19; 358/1.14, 358/1.16, 1.17

(56) References Cited

U.S. PATENT DOCUMENTS

| | | | | |
|---|---|---|---|---|
| 3,576,982 A | | 5/1971 | Duke | |
| 4,485,471 A | | 11/1984 | Singh et al. | |
| 4,651,307 A | | 3/1987 | Toumayan et al. | |
| 4,768,169 A | | 8/1988 | Perlegos | |
| 4,888,686 A | | 12/1989 | Sinz et al. | |
| 4,920,518 A | | 4/1990 | Nakamura et al. | |
| 4,965,828 A | | 10/1990 | Ergott, Jr. et al. | |
| 5,109,360 A | | 4/1992 | Inazumi et al. | |
| 5,146,431 A | * | 9/1992 | Eby et al. | 365/238.5 |
| 5,195,100 A | | 3/1993 | Katz et al. | |
| 5,210,716 A | | 5/1993 | Takada | |
| 5,379,415 A | | 1/1995 | Papenberg et al. | |
| 5,434,868 A | | 7/1995 | Aichelmann, Jr. et al. | |
| 5,475,697 A | | 12/1995 | Katz et al. | |
| 5,495,570 A | | 2/1996 | Heugel et al. | |
| 5,502,728 A | | 3/1996 | Smith, III | |
| 5,553,231 A | | 9/1996 | Papenberg et al. | |
| 5,553,263 A | | 9/1996 | Kalish et al. | |
| 5,619,642 A | | 4/1997 | Nielson et al. | |
| 5,627,572 A | * | 5/1997 | Harrington, III et al. | 347/23 |
| 5,644,699 A | | 7/1997 | Yoshida | |
| 5,659,678 A | | 8/1997 | Aichelmann, Jr. et al. | |
| 5,832,005 A | | 11/1998 | Singh | |
| 5,862,151 A | | 1/1999 | Fagerness | |
| 5,864,657 A | | 1/1999 | Stiffler | |
| 5,905,854 A | | 5/1999 | Nielson et al. | |
| 5,905,858 A | | 5/1999 | Jeddeloh | |
| 5,907,671 A | | 5/1999 | Chen et al. | |
| 5,917,838 A | | 6/1999 | Wardrop | |

(List continued on next page.)

FOREIGN PATENT DOCUMENTS

| | | | |
|---|---|---|---|
| WO | WO 9965695 | 12/1999 | |
| WO | WO 99/65695 A1 * | 12/1999 | B41J/2/195 |

OTHER PUBLICATIONS

M.Morris Mano, Digital Design 1991, Prentice–Hall, Inc. 2nd ed. ,pp.180–186, 299–302.*
Richard C. Dorf, The Electrical Engineering Handbook 1997, CRC Press, 2nd ed. ,pp. 1805–1813.*
M. Morris Mano, "Digital Design," 2nd ed., Prentice–Hall (Upper Saddle River, NJ 07458), (Feb. 17, 1991).
Richard C. Dorf, "The Electrical Engineering Handbook," 2nd ed., CRC Press, (Feb. 17, 1997).

*Primary Examiner*—Lamson Nguyen
*Assistant Examiner*—Blaise Mouttet
(74) *Attorney, Agent, or Firm*—Taylor & Aust, P.C.

(57) ABSTRACT

A method of storing usage information in an ink jet printer includes storing low priority usage information in a first memory field. First high priority usage information is stored in a second memory field. Second high priority usage information is stored in a third memory field. The second high priority usage information is substantially identical to the first high priority usage information.

22 Claims, 5 Drawing Sheets

U.S. PATENT DOCUMENTS 5,935,258 A 8/1999 Klein
5,943,287 A 8/1999 Walton
5,954,828 A 9/1999 Lin
5,978,931 A 11/1999 Kirihata et al.
6,002,846 A * 12/1999 Okamoto ..... 358/1.16
6,016,553 A 1/2000 Schneider et al.
6,041,422 A 3/2000 Deas
6,154,847 A 11/2000 Schofield et al.
6,181,614 B1 1/2001 Aipperspach et al.

* cited by examiner

Start
Update low priority ?
No
Yes
S34
Build low priority data and checksun
S36
Write low priority data
S38
Read low priority data
S40
Checksun good ?
Yes
No
Twice ?
No
Yes
ERROR
Update high priority ?
No
S42
Yes
Build high priority data and checksun
S44
Write high priority data
S46
Read high priority data
S48
Checksun good ?
Yes
No
Twice ?
No
Yes
ERROR

METHOD AND APPARATUS FOR NON-VOLATILE MEMORY USAGE IN AN INK JET PRINTER

BACKGROUND OF THE INVENTION

1. Field of the Invention

The present invention relates to ink jet printers, and, more particularly, to memory usage in ink jet printers.

2. Description of the Related Art

Non-volatile memory modules are used in ink jet printers to store data such as ink usage information. Non-volatile memory modules generally retain their contents over a loss of power. However, there is nothing to prevent corruption of the data contents of the non-volatile memory if a loss of power occurs while data is being written into the non-volatile memory. Such a data corruption can be catastrophic; for example, a loss of ink usage information could destroy the printhead by firing a "dry" printhead. Another possibility is that a loss of the ink tank installation date could incorrectly expire a supply item earlier than it should, thus increasing the cost of supplies.

A window of opportunity exists for the corruption of memory module data, because much of the data exists in the form of multiples of discrete data values. If a power loss occurs in the middle of writing this data, data corruption will occur. For example, assume that the ink usage is stored in two bytes in the memory module. If a power loss occurs after the first byte has been written, but before the second byte has been written, the ink usage information has been corrupted.

What is needed in the art is a method of minimizing the damage to memory contents in the event that a power loss occurs during a data write operation.

SUMMARY OF THE INVENTION

The present invention provides a write fault tolerant non-volatile memory usage algorithm.

The invention comprises, in one form thereof, a method of storing usage information in an ink jet printer. Low priority usage information is stored in a first memory field. First high priority usage information is stored in a second memory field. Second high priority usage information is stored in a third memory field. The second high priority usage information is substantially identical to the first high priority usage information.

The invention comprises, in another form thereof, an ink jet printer including a memory module having a first field containing low priority usage information, a second field containing first high priority usage information, and a third field containing second high priority usage information substantially identical to the first high priority usage information.

An advantage of the present invention is that, in the event of a loss of power, usage information in a non-volatile memory is not corrupted.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
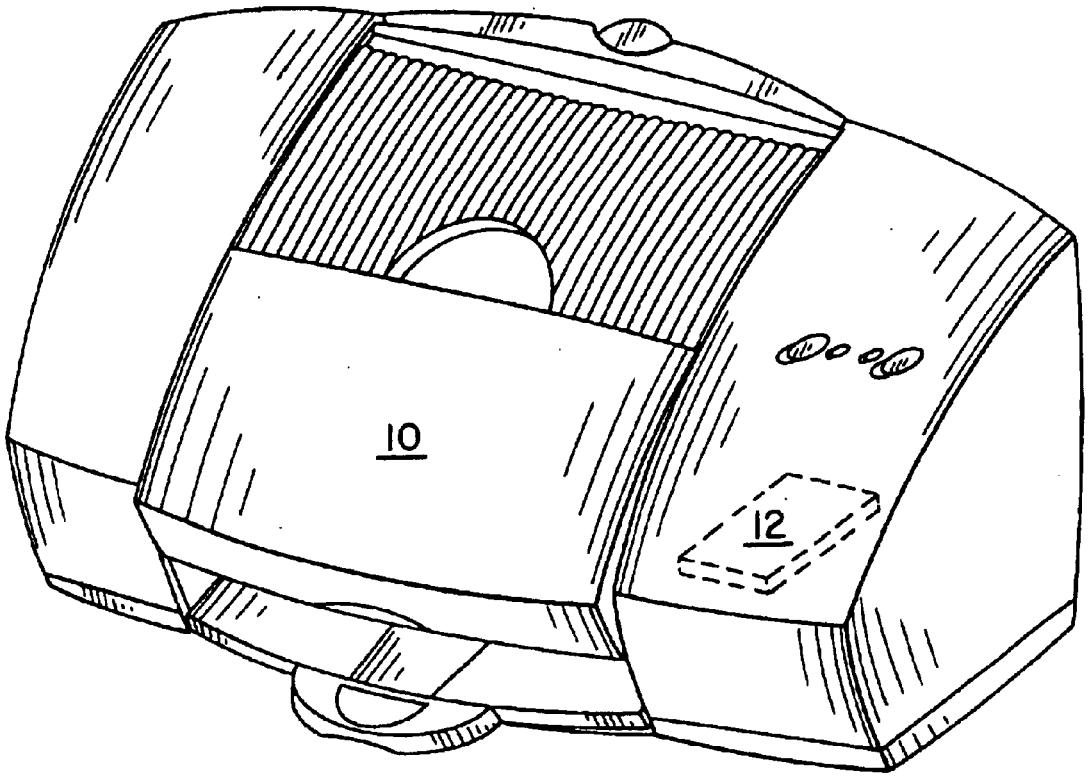
FIG. 1 is a perspective view of an ink jet printer which can be used in conjunction with the method of the present invention.

Referring now to the drawings and particularly to FIG. 1, there is shown one embodiment of an ink jet printer 10 utilizing the method of the present invention. Printer 10 includes a non-volatile memory module 12 that records usage information. In the normal operation of printer 10, supply usage along with other information is stored in module 12. This usage information is used to track information such as printhead and ink tank life. Module 12 can contain information such as manufacturing related information; thermal, fluidic, and electrical parametrics; usage information—ink level, printhead life; supply item information; diagnostic information: and maintenance parameters.

Module 12 can be contained within the printhead and ink tank chiclets (not shown). Although only one memory module 12 is described herein, it is to be understood that printer 10 can include several memory modules 12, with each module 12 being associated with a respective printhead and/or ink tank.

The present invention combats corruption of non-volatile memory module information. Memory module 12 is partitioned into four separate fields.

The first field contains data pertaining to the supply item that has been determined at the time of manufacture. This data never needs to be changed by printer 10, and is set up in non-volatile memory module 12 as read-only. Data of this type generally includes starting ink, ink drop volume, and fire-energy information. That is, the read-only data includes information related to the manufacture of a supply item (tank or printhead) and parametrics associated with the printhead or ink. More particularly, the read-only data can include the starting ink volume, maintenance parameters, energy delivery parameters, ink lot number, fire rate parameters, drop mass parameters, ink identification, manufacturing date, trademark, part number, thermal control parameters, original equipment manufacturer (OEM) identification, serial number, supply item expiration parameters, electrical parameters (voltages, resistances), chip placement information (used for print registration), and usage limits (life).

Because the first field is set up as read-only by memory 12, data cannot be corrupted by printer 10 if a write addressing error occurs during a power loss. This prevents errors such as an accidental clearing of the starting ink. An error of this nature would immediately expire the supply item upon the next power-up.

The second field contains high priority data that printer 10 uses to record usage information, which if corrupted, would invalidate the supply item. This field is set up to allow read and write access by printer 10 at the time of manufacture, and contains critical supply information such as ink usage or ink level information for the tanks, and printhead life usage or usage information for the printheads. The validity of the data is determined by a checksum byte stored at the end of the field. This checksum is the sum of all the data stored in this field, and is maintained by printer 10. A new checksum is calculated when printer 10 saves new usage information, and this checksum is used to determine if the information in this field is valid when printer 10 powers up.

The integrity of the data in the second field is maintained by copying its data into a redundant copy, the third field. This third field is also a read-write field and is checksummed in the same manner as the second field. The redundant third field is updated immediately after the primary second field, and is a mirror copy of the second field. This third field provides protection in that both the primary and the redundant data copy fields cannot be corrupted at the same time by a loss of power during a write operation. If printer 10 determines that a corruption of data exists in the second field, printer 10 can use the data from this third field.

The fourth field contains low priority data that printer 10 uses to record usage information that would not be considered catastrophic if corrupted. This fourth field is set up as readable and writable by printer 10 at the time of manufacture. Data of this nature include "number of wet-wipes performed", "last ink-float read", thermal parametrics (measured in the printer) installation date, error codes (for failure diagnostics), idle time, maintenance parameters, missing nozzle information, chip placement information (programmed at manufacturing test), ink level parameters (measured in the printer), etc.

The fourth field is validated by a checksum byte that is stored at the end of the field. This checksum is used upon power-up of printer 10 to determine if the contents of the fourth field are valid. If the contents are determined to be invalid, the entire field is cleared, and a new checksum is calculated. Before powering down, and at periodic intervals, the data in this fourth field is stored, and its corresponding checksum calculated and stored.

Figure 2A:
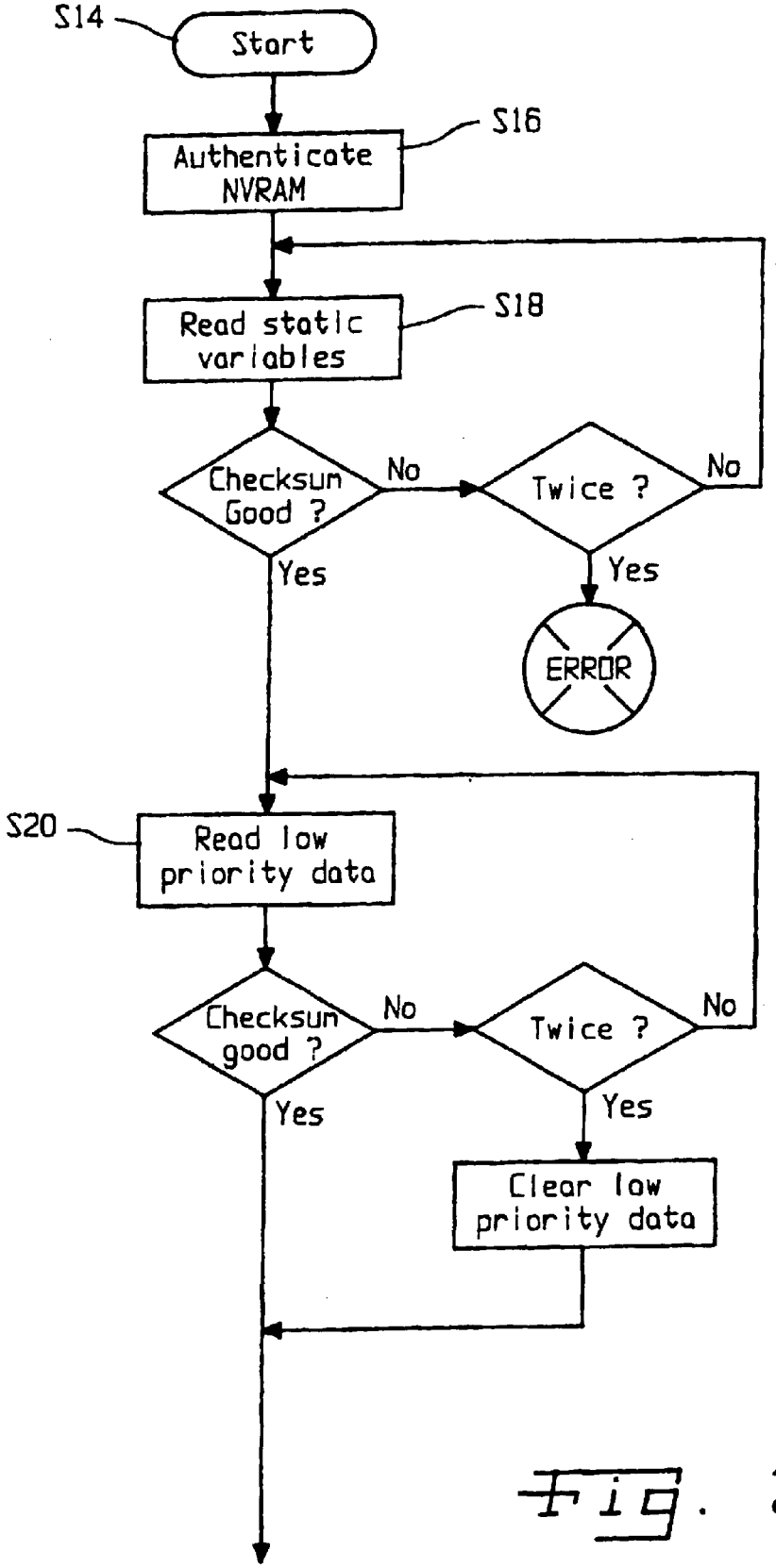
FIG. 2 is a flow chart of authenticating non-volatile memory modules according to one embodiment of the method of the present invention.
Figure 2B:
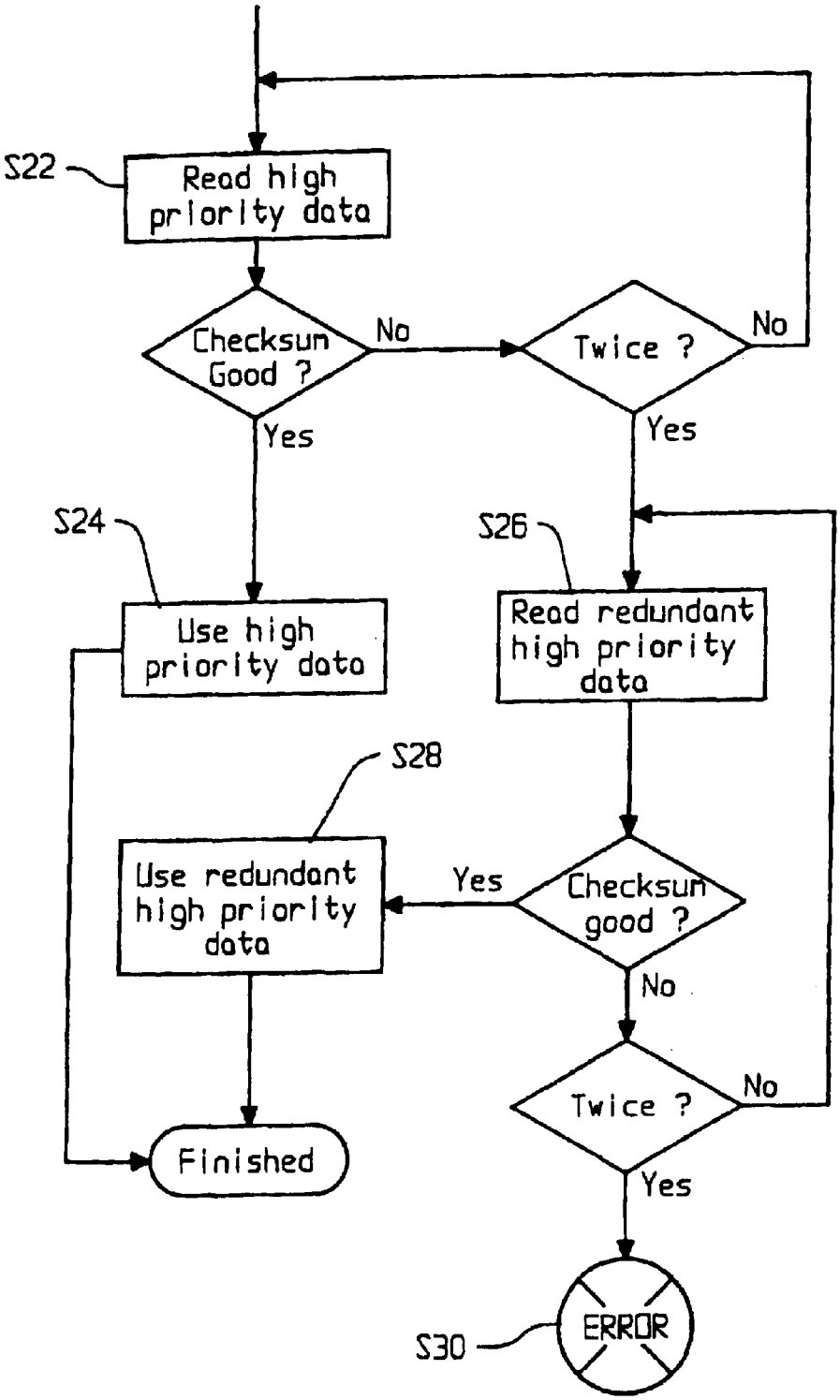
Figure 3A:
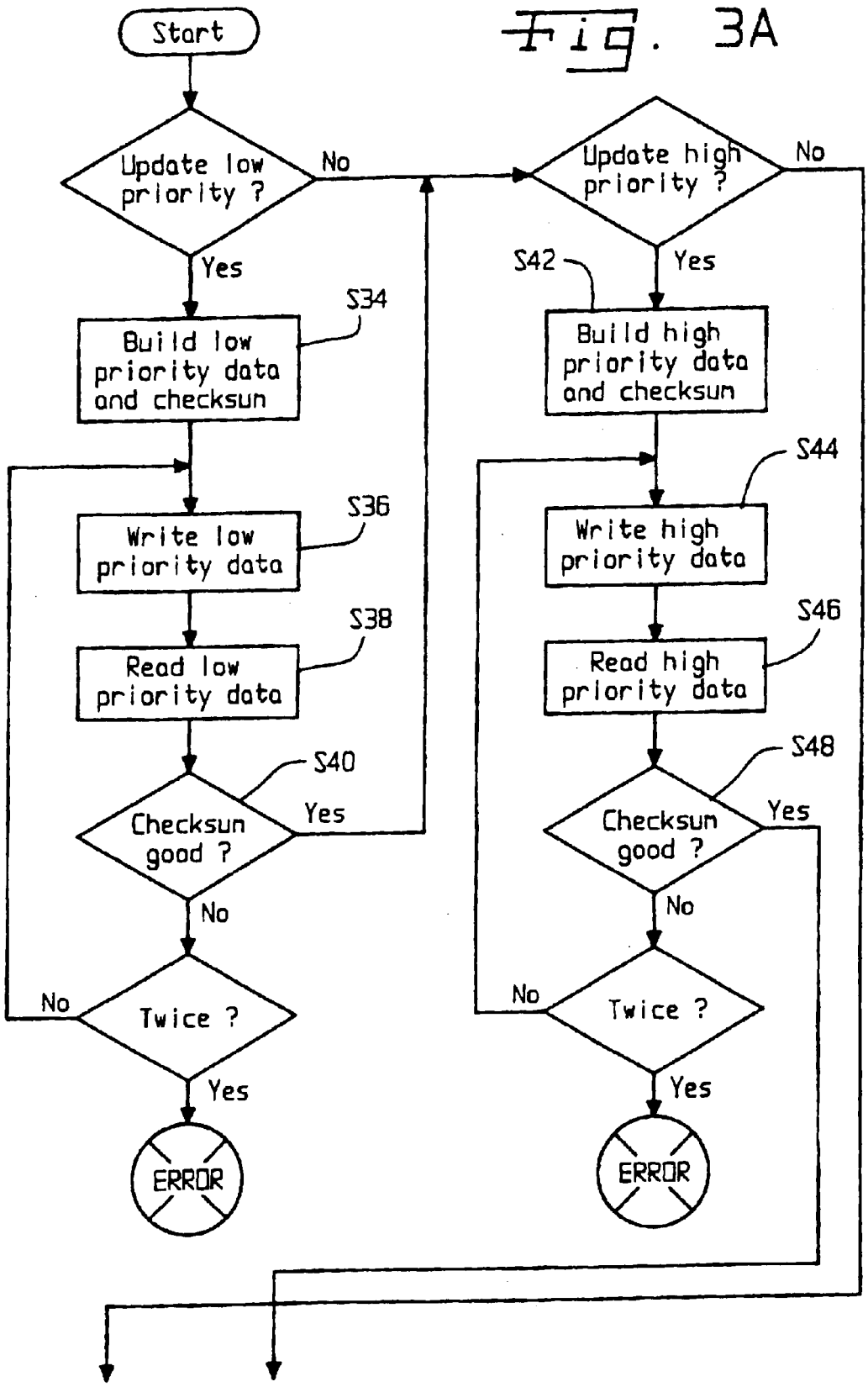
FIG. 3 is a flow chart of updating non-volatile memory modules according to one embodiment of the method of the present invention.
Figure 3B:
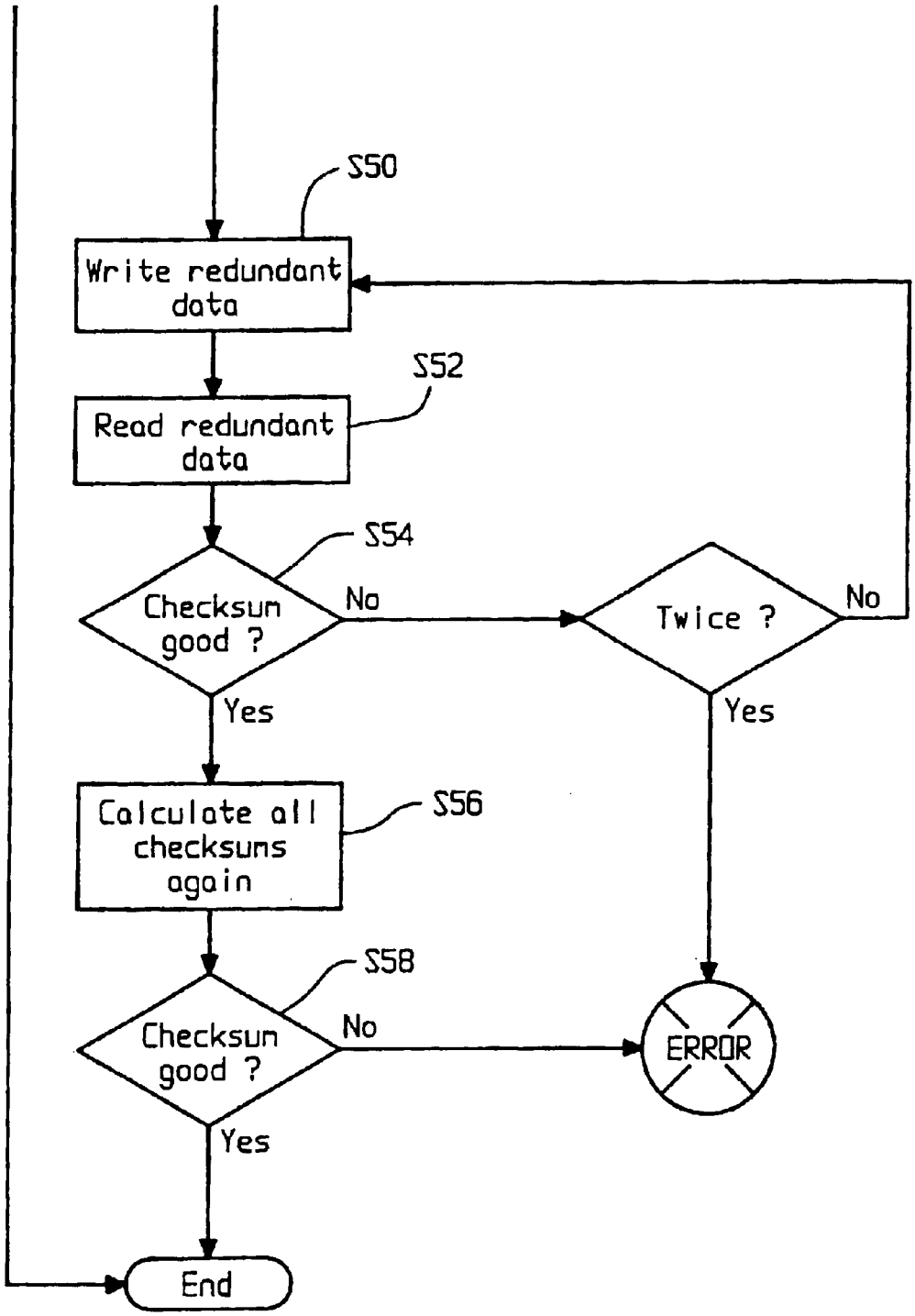

The following algorithm describes the implementation of these four fields in the printheads and ink tanks of printer 10. Upon power-up (step S14, FIG. 2), printer 10 authenticates non-volatile memory module 12 (step S16). This step is required in order to unlock and read the memory module contents. Printer 10 then reads the read-only static variables stored in the first field (step S18). The read is performed a second time if a checksum failure is detected in order to differentiate between true data corruption, and problems (noise) which could occur during the memory read.

Printer 10 proceeds to read the fourth field (step S20), the low-priority read-write data. The read is performed a second time if a checksum failure is detected in order to differentiate between true data corruption, and problems (noise) which could occur during the memory read. If a checksum mismatch occurs a second time, the fourth field data is considered invalid, and is cleared.

Printer 10 then reads the second field (step S22), i.e., the high priority data field. The second field's checksum is observed. The second field is read a second time if it is determined to have a bad checksum. A decision is made as to which copy of the high priority data is to be used. If the second field's checksum is valid, the second field's data is used (step S24).

If the second field's checksum is determined to be invalid a second time, printer 10 reads the third field (step S26), i.e., the redundant high priority data field. The third field's checksum is observed. The third field is read a second time if it is determined to have a bad checksum. If the third field's checksum is determined to be valid, the third field's data is used (step S28). and the second field's data is corrected upon the next memory write. If the third field's checksum is determined to be invalid, an unrecoverable error has occurred, and the operation stops (step S30).

Upon power-down, and periodically during the printer's operation, printer 10 stores usage information to memory module 12. No data is stored in the first field, as it is read-only.

The fourth field data is observed, and a checksum calculated (step S34). The data along with its checksum is written to memory module 12 (step S36). This data is immediately read back (step S38) and the checksum is used to verify a valid write (step S40). This may be repeated again, to ensure the data is correctly written into the fourth field.

The second field high-priority read-write data is then collected and its new checksum calculated (step S42). This data is written to the second memory module field (step S44), also being read back (step S46) and the checksum is used to verify a proper write (step S48).

The same data is also written to the third field (step S50), the redundant high-priority field. This is to verify that the third field is an exact duplicate of the second field. The data is then read back (step S52) and the checksum is used to verify a proper write (step S54).

All checksums are calculated one final time (step S56) and their validity is confirmed (step S58).

This "mirror image" copy of the read-write data, along with the read-only protection of critical manufacturing data provides the fault tolerance necessary to control critical supply elements that are vulnerable to instantaneous power outages.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of storing usage information in an ink jet printer, said method comprising:

updating said usage information in at least one memory module, said updating including the steps of:

storing low priority usage information in a first memory field;

storing first high priority usage information in a second memory field;

verifying said first high priority usage information has been written properly; and subsequently storing second high priority usage information in a third memory field, said second high priority usage information being substantially identical to said first high priority usage information.

2. The method of claim 1, wherein each of said first memory field, said second memory field and said third memory field can be both read and written to.

3. The method of claim 2, wherein if power is lost to the printer while writing to one of said second memory field and said third memory field, said information in the other of said second memory field and said third memory field is not corrupted.

4. The method of claim 1, wherein said first high priority usage information and said second high priority usage information each include at least one of ink usage and print head life usage.

5. The method of claim 1, wherein said low priority usage information includes at least one of a number of wet-wipes performed and a last ink-float read.

6. The method of claim 1, comprising the further step of storing read-only information in a fourth memory field.

7. The method of claim 6, wherein said read-only information is determined at a time of manufacture of the printer.

8. The method of claim 6, wherein said read-only information includes at least one of starting ink, ink drop volume, and fire energy information.

9. The method of claim 6, comprising the further step of storing at least one checksum byte associated with at said fourth memory field.

10. The method of claim 1, comprising the further step of storing at least one checksum byte associated with at least one of said first memory field, said second memory field and said third memory field.

11. The method of claim 10, wherein data stored in said at least one checksum byte is dependent upon at least one of said low priority usage information, said first high priority usage information and said second high priority usage information.

12. The method of claim 11, comprising the further step of using said at least one checksum byte to determine whether at least one of said low priority usage information, said first high priority usage information and said second high priority usage information is valid when the printer powers up.

13. The method of claim 1, comprising the further step of using said second high priority usage information in lieu of said first high priority usage information if said first high priority usage information is corrupted.

14. The method of claim 1, wherein said at least one memory module is a non-volatile memory module containing said first memory field, said second memory field and said third memory field.

15. The method of claim 14, comprising the further step of authenticating said at least one non-volatile memory module upon power-up of the printer.

16. An ink jet printer, comprising a non-volatile memory module including:

a first field containing low priority usage information;

a second field containing first high priority usage information; and a third field containing second high priority usage information substantially identical to said first high priority usage information.

17. The ink jet printer of claim 16, wherein said memory module includes a fourth field containing read-only information.

18. The ink jet printer of claim 17, wherein said memory module includes at least one checksum byte associated with said fourth field.

19. The ink jet printer of claim 16, wherein said memory module includes at least one checksum byte associated with at least one of said first field, said second field and said third field.

20. The ink jet printer of claim 19, wherein said at least one checksum byte contains data that is dependent upon at least one of said low priority usage information, said first high priority usage information and said second high priority usage information.

21. The ink jet printer of claim 16, wherein said third field defines a means of preventing said first high priority usage information from being lost if power to the printer is interrupted while said second field is being written to.

22. A method of updating usage information in an ink jet printer, said method comprising the steps of:

storing first usage information in a first memory field;

verifying said first usage information has been written properly; and subsequently storing second usage information in a second memory field, said second usage information being substantially identical to said first usage information.

* * * * *